US010950207B2

(12) United States Patent
Lee et al.

(10) Patent No.: US 10,950,207 B2
(45) Date of Patent: Mar. 16, 2021

(54) DISPLAY DEVICE AND METHOD FOR DISPLAYING IMAGES USING A DISPLAY DEVICE

(71) Applicant: SAMSUNG DISPLAY CO., LTD., Yongin-si (KR)

(72) Inventors: Se Keun Lee, Yongin-si (KR); Jae Woo Ryu, Suwon-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 16/508,721

(22) Filed: Jul. 11, 2019

(65) Prior Publication Data

US 2020/0111455 A1 Apr. 9, 2020

(30) Foreign Application Priority Data

Oct. 4, 2018 (KR) ..... 10-2018-0118386

(51) Int. Cl.
*G09G 5/38* (2006.01)
*G09G 3/20* (2006.01)
*G09G 5/373* (2006.01)

(52) U.S. Cl.
CPC ..... *G09G 5/38* (2013.01); *G09G 3/2007* (2013.01); *G09G 5/373* (2013.01); *G09G 2320/0257* (2013.01); *G09G 2320/046* (2013.01); *G09G 2320/048* (2013.01); *G09G 2330/10* (2013.01)

(58) Field of Classification Search
None
See application file for complete search history.

(56) References Cited

U.S. PATENT DOCUMENTS

2007/0096767 A1* 5/2007 Tsai ..... G09G 3/007 324/760.01
2012/0056916 A1* 3/2012 Ryu ..... G09G 5/10 345/691
2015/0154910 A1* 6/2015 Okuno ..... G09G 3/3283 345/212
2017/0221455 A1* 8/2017 Lee ..... G09G 3/3225
2018/0197480 A1* 7/2018 Choi ..... H04N 13/344
2018/0286356 A1* 10/2018 Jiang ..... G09G 5/36
2019/0278323 A1* 9/2019 Aurongzeb ..... G06F 1/1641

FOREIGN PATENT DOCUMENTS

KR 10-2007-0010710 1/2007
KR 10-2016-0071886 6/2016
KR 10-2017-0088452 8/2017
KR 10-2017-0090557 8/2017
KR 10-2018-0006584 1/2018
KR 10-2018-0045936 5/2018

* cited by examiner

*Primary Examiner* — Nurun N Flora
(74) *Attorney, Agent, or Firm* — F. Chau & Associates, LLC

(57) ABSTRACT

A display device according to an exemplary embodiment includes a display panel that includes a plurality of pixels, and an image shifter that corrects an image corresponding to input image data to be shifted based on age data with respect to the plurality of pixels and an input grayscale of input image data and outputs corrected image data, wherein a shift range of the image is reduced when an age value of the age data exceeds a threshold value.

18 Claims, 16 Drawing Sheets

FIG. 10

LUT

AGE

GRAY

| 8bit | 13bit | 0 | 1 | 2 | 3 | 4 | 5 | ··· | 1021 | 1022 | 1023 |
|---|---|---|---|---|---|---|---|---|---|---|---|
| 0 | 0 | 0 | 0 | 0 | 0 | 0 | 0 | ··· | 0 | 0 | 0 |
| 1 | 32 | 32 | 34 | 36 | 38 | 40 | 41 | ··· | 64 | 64 | 65 |
| 2 | 64 | 64 | 66 | 68 | 70 | 72 | 73 | ··· | 94 | 94 | 95 |
| ··· | ··· | ··· | ··· | ··· | ··· | ··· | ··· | ··· | ··· | ··· | ··· |
| ··· | ··· | ··· | ··· | ··· | ··· | ··· | ··· | ··· | ··· | ··· | ··· |
| 254 | 8128 | 8128 | 8172 | 8189 | 8192 | 8192 | 8192 | ··· | 8192 | 8192 | 8192 |
| 255 | 8160 | 8160 | 8181 | 8192 | 8192 | 8192 | 8192 | ··· | 8192 | 8192 | 8192 |
| 256 | 8192 | 8192 | 8192 | 8192 | 8192 | 8192 | 8192 | ··· | 8192 | 8192 | 8192 |
| | | | | | | | | | | | |
| ASR | | 1.000 | 0.995 | 0.992 | 0.988 | 0.984 | 0.982 | ··· | 0.723 | 0.715 | 0.709 |

FIG. 13 a b

| | | | | | |
|---|---|---|---|---|---|
| 1.02 | 1.01 | … | … | 1.00 | 1.00 |
| 1.02 | 1.00 | … | … | 0.99 | 0.98 |
| … | … | … | … | … | … |
| 1.04 | 1.03 | … | … | 0.99 | 0.98 |
| 1.05 | 1.04 | … | … | 0.99 | 0.98 |

DISPLAY DEVICE AND METHOD FOR DISPLAYING IMAGES USING A DISPLAY DEVICE

CROSS-REFERENCE TO RELATED APPLICATION

This application claims priority to and the benefit of Korean Patent Application No. 10-2018-0118386 filed in the Korean Intellectual Property Office on Oct. 4, 2018, the entire contents of which are incorporated by reference herein.

BACKGROUND

(a) Field

The present disclosure relates to a display device and a method for displaying an image thereof.

(b) Description of the Related Art

When a display device (e.g., an organic light emitting display (OLED) device) continuously outputs a specific image or character for a long time, specific pixels may become degraded. For example, an image may become burned-in or become subject to image sticking. The pixel degradation may also be referred to as age or stress.

Some electronic devices incorporate methods to compensate for pixel stress and/or image sticking. For example, an image may be shifted at regular intervals to prevent degradation. However, if an image is continuously shifted by repeating the same pattern, the image may become distorted.

SUMMARY

Exemplary embodiments are provided to prevent degradation of pixels, image sticking, and image distortion in a display device. A display device according to an exemplary embodiment includes: a display panel that includes a plurality of pixels; and an image shifter configured to correct an image corresponding to input image data to be shifted based on age data with respect to the plurality of pixels and an input grayscale of input image data and outputs corrected image data, wherein the image shifter is configured to reduce a shift range of the image when an age value of the age data exceeds a threshold value.

The shift range of the image may be increased as the age value of the age data increases to below the threshold value. When the age value of the age data exceeds the threshold value, the shift range of the image may be determined by a pixel unit. When the age data is below the threshold value, the shift range of the image may be determined by a pixel block unit that includes a predetermined number of pixels.

The display device may further include an image sticking compensator configured to generate the age data, and to output age compensation data based on the age data and an input grayscale of the corrected image data. The image sticking compensator may include: a degradation calculator that calculates a degradation weight value based on the corrected image data, and calculates degradation data of one frame; an accumulator that accumulates the degradation data and generates the degradation data-accumulated age data; and a compensator configured to determine a grayscale compensation value corresponding to the age data and the input grayscale of the input image data, and outputs age compensation data by applying the grayscale compensation value to the input image data.

The compensator may divide the display panel into a plurality of blocks, sets block weight values with respect to the respective blocks, may further apply the block weight values to the age data, and may determine the grayscale compensation value based on the block weight value-applied age data.

When an average of age values of pixels included in a block along the plurality of blocks exceeds the threshold value, the compensator may reduce block weight values of the block and the neighboring blocks of the block.

The display device may further include a scaler that generates a grayscale scaled from the input grayscale based on a scaling ratio that corresponds to the age data to prevent saturation of the grayscale compensation value due to accumulation of the degradation data.

The image shifter may generate the corrected image data by enlarging or reducing an area in the image displayed by the input image data according to the image shift range.

A method for displaying an image of a display device according to an exemplary embodiment includes: calculating degradation weight values with respect to a plurality of pixels included in a display panel based on input image data, and calculating degradation data of one frame; generating age data by accumulating the degradation data; and generating corrected image data by shifting an image corresponding to the input image data based on the age data and an input grayscale of the input image data, wherein a shift range of the image is reduced when an age value of the age data exceeds a threshold value.

The shift range of the image may be increased as the age value of the age data increases to below the threshold value. When the age value of the age data exceeds the threshold value, the shift range of the image may be determined by a pixel unit. When the age data is below the threshold value, the shift range of the image may be determined on the basis of a pixel block that includes a predetermined number of pixels.

The method for displaying an image of the display device may further include, after generating the age data, determining a grayscale compensation value that corresponds to the age data and an input grayscale of the input image data and generating age compensation data by applying the grayscale compensation value to the input image data.

The method for displaying an image of the display device may further include, before the grayscale compensation value is determined, generating a grayscale scaled from the input grayscale based on a scaling ratio that corresponds to the age data to prevent saturation of the grayscale compensation value due to accumulation of the degradation data.

The determining the grayscale compensation value may include: dividing the display panel into a plurality of blocks, and setting block weight values with respect to the blocks; and further applying the block weight value to the age data, and determining the grayscale compensation value based on the age data to which the block weight value is applied.

The setting the block weight values may include, when an average of age values of pixels included in a block along the plurality of blocks exceeds the threshold value, reducing block weight values of the block and the neighboring blocks of the block.

The generating the corrected image data may include generating the corrected image data by enlarging or reducing one area in an image displayed by the input image data according to the image shift range.

A display device according to another exemplary embodiment includes: a display panel that includes a plurality of pixels; and an image sticking compensator configured to determine a grayscale compensation value corresponding to age data with respect to the plurality of pixels and input image data, and outputs age compensation data by applying the grayscale compensation value to the input image data, wherein the image sticking compensator is further configured to divide the display panel into a plurality of blocks, set block weight values with respect to the respective blocks, apply the block weight value to the age data, and determine the grayscale compensation value based on the block weight value-applied age data, and wherein the image sticking compensator is further configured to reduce block weight values of the block and the neighboring blocks of the block when an average of age values of pixels included in a block along the plurality of blocks exceeds the threshold value.

According to exemplary embodiments, degradation of pixels may be prevented, thereby suppressing occurrence of image sticking. According to exemplary embodiments, image distortion due to pixel shift may be minimized.

BRIEF DESCRIPTION OF THE DRAWINGS

FIG. 10 is a block diagram of an example of a lookup table included in the memory of FIG. 8.

FIG. 13 shows an example in which the compensator of FIG. 8 further applies a block weight value to the age data.

DETAILED DESCRIPTION OF THE EMBODIMENTS

Figure 1:
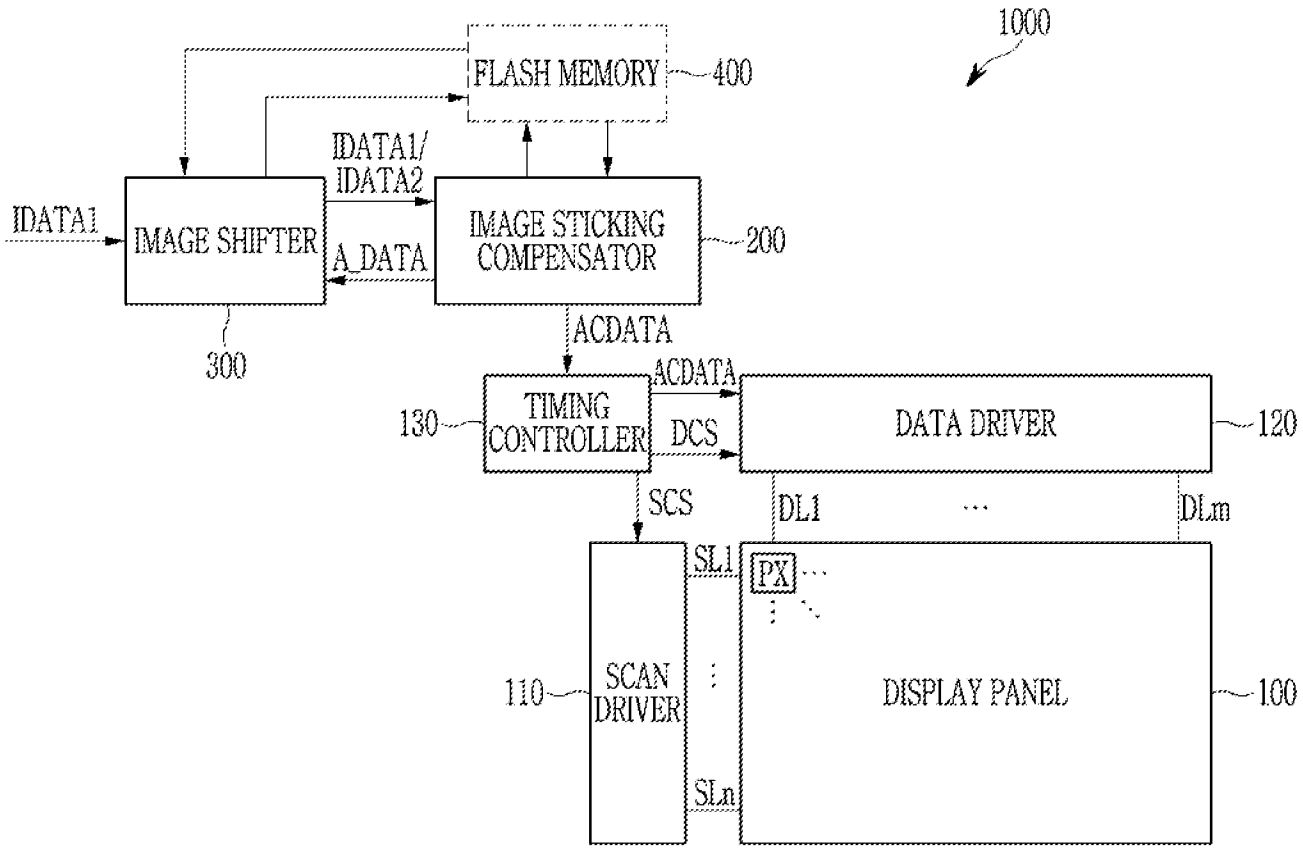
FIG. 1 is a block diagram of a display device according to exemplary embodiments.

Hereinafter, example embodiments of the present disclosure will be described in more detail with reference to the accompanying drawings. As those skilled in the art will understand, the described embodiments may be modified in various ways without departing from the spirit or scope of the present disclosure.

The drawings and description are to be regarded as illustrative in nature and not restrictive. Like reference numerals designate like elements throughout the specification. In addition, unless explicitly described to the contrary, the word "comprise" and variations such as "comprises" or "comprising" will be understood to imply the inclusion of stated elements but not the exclusion of any other elements.

When a display device (e.g., an organic light emitting display (OLED) device) continuously outputs a specific image or character for a long time, specific pixels may become degraded. For example, an image may become burned-in or become subject to image sticking. The pixel degradation may also be referred to as age or stress.

Some electronic devices incorporate methods to compensate for pixel stress and/or image sticking. For example, an image may be shifted at regular intervals to prevent degradation, or the device may adjust an image signal to compensate for the degradation of specific pixels. However, if an image is shifted by repeating the same pattern, the area where the pixel may be shifted may be limited. his may reduce the performance improvement that results from image shifting. Furthermore, if a pixel is degraded beyond a threshold value, targeted luminance may not be achieved by after compensation.

The present disclosure describes systems and methods for preventing and compensating for pixel degradation. The described systems may include one or both of an image shifter and an image sticking compensator. First, an image shifter may shift an image in order to reduce the rate of pixel degradation. The pattern applied by the image shifter, or the range over which the image is shifted may depend on the accumulated pixel degradation. For example, if the degradation of a pixel or set of pixels exceeds a threshold amount, the range of the image shifting may be reduced. After the image shifting, an image sticking compensator may determine and age compensation data and transmit the age compensation data to a timing controller to drive a display panel.

FIG. 1 is a block diagram of a display device according to exemplary embodiments. Referring to FIG. 1, a display device 1000) may include a display panel 100, a scan driver 110, a data driver 120, a timing controller 130, an image sticking compensator 200, and an image shifter 300.

The display device 1000 may include an organic light emitting diode (OLED) display, a liquid crystal display (LCD), and the like. Additionally or alternatively, the display device 1000 may comprise a flexible display device, a rollable display device, a curved display device, a transparent display device, a mirror display device, and the like, which can be implemented by using the organic light emitting diode (OLED) display or another suitable display.

The display panel 100 may include a plurality of pixels PX, and may display an image. Specifically, the display panel 100 may include a plurality of pixels PX that are connected to corresponding scan lines among a plurality of scan lines SL1 to SLn and corresponding data lines among a plurality of data lines DL1 to DLm.

The scan driver 110 may provide a scan signal to pixels PX of the display panel 100 through the scan lines SL1 to SLn. The scan driver 110 may provide the scan signal to the display panel 100 based on a first control signal SCS received from the timing controller 130.

The data driver 120 may provide a data signal corresponding to age compensation data ACDATA to the pixels PX of the display panel 100 through the data lines DL1 to DLm. The data driver 120 may provide the data signal to the display panel 100 based on a second control signal DSC received from the timing controller 130. In an exemplary embodiment, the data driver 120 may include a gamma corrector (or gamma voltage generator) that converts the age compensation data ACDATA to a voltage that corresponds to the data signal. The age compensation data ACDATA in a grayscale domain may be converted to a data voltage in a voltage domain by the gamma corrector. In an exemplary embodiment, the gamma corrector may be separated from the data driver. For example, the gamma corrector receives an input gray data scaled by a gray scaler, and may convert the scaled input gray data to a gray voltage in the voltage domain. A compensator adds a compensation value to the gray voltage in the voltage domain and provides the compensated gray voltage in the voltage domain to the data driver 120.

The timing controller 130 may receive input image data IDATA1 from an external graphics source and the like or may receive the age compensation data ACDATA from the image sticking compensator 200. The timing controller 130 may control driving of the scan driver 110 and the data driver 120. The timing controller 130 may control the scan driver 110 and the data driver 120 by generating the first and second control signals SCS and DCS and providing the first and second control signals SCS and DCS to the scan driver 110 and the data driver 120.

In an exemplary embodiment, the timing controller 130 may further control driving of the image sticking compensator 200 and the image shifter 300.

Each pixel PX may be subject to stress caused by, for example, the current flowing to each pixel PX, the light emission duration of each pixel PX, and the temperature of the display panel 100 per frame. Due to the stress accumulated in each pixel PX, the pixels PX may be degraded and an afterimage may be expressed.

Thus, the display portion 100 may provide degradation information (or age information) of pixels PX, generated through pixel sensing and the like, to the image sticking compensator 200. The degradation information may include light emission duration, grayscales, luminance, temperature, and the like. The degradation information may be generated for each pixel or a pixel block unit including grouped pixels. In an exemplary embodiment, pixels PX may include subpixels, each may emit light of a specific color (e.g., red, green, or blue).

The image sticking compensator 200 may output the age compensation data ACDATA based on degradation information and an input grayscale of the input image data IDATA1. That is, the image sticking compensator 200 may determine an individual compensation grayscale value for each pixel PX. In an exemplary embodiment, the image sticking compensator 200 includes a degradation calculator that calculates deterioration data based on the input image data IDATA1 and calculates deterioration data of a single frame. The image sticking compensator 200 may also include an accumulator that generates the age data by accumulating the degradation data, a scaler that generates a grayscale scaled from an input grayscale of the input image data based on a scaling ratio corresponding to the age data, and a compensator configured to determine a grayscale compensation value corresponding to the age data and the scaled grayscale, and to output age compensation data ACDATA by applying the grayscale compensation value to the input image data.

In some cases, the age compensation data ACDATA may be used both to compensate an image in a particular frame, and also as an input for the image shifter 300 to shift an image in the current or subsequent frames. In some examples, the image sticking compensator is configured to apply a block weight value to the age data, and determine the grayscale compensation value based on the block weight value-applied age data. The block weight values of a pixel block and its neighbors may be reduced when the average of age values of pixels exceeds the threshold value. This may prevent the degradation of the pixel block from becoming noticeable.

In an exemplary embodiment, the image sticking compensator 200 may be implemented as an additional application processor. Alternatively, in another exemplary embodiment, the image sticking compensator 200 may be included in the timing controller 130. In another exemplary embodiment, the image sticking compensator 200 may be included in the data driver 120.

In an exemplary embodiment, the accumulated data may be stored in an external flash memory 400.

The image shifter 300 receives first input image data IDATA1 from an external graphics source and the like, and outputs first input image data IDATA1 or second input image data IDATA2 to the image sticking compensator 200.

The image shifter 300 receives age data A_DATA from the image sticking compensator 200 and determines an image shifting range. For example, the image shifter 300 increases the image shifting range according to an age value of a pixel block by referring to the age data A_DATA. The image shifter 300 may adjust the image shifting range when an age value of the pixel block exceeds a threshold value. Thus, the image shifter 300 may alter the pattern for shifting the image based on the age values of the pixels. The image shifting range may correspond to a pixel unit or a pixel block unit. The image shifting will be described later with reference to FIG. 5 to FIG. 7.

The image shifter 300 corrects the first input image data IDATA1 to produce the second input image data IDATA2 according to the determined image shifting range and a shifting path. The shifting path is pre-stored in (e.g., in the external flash memory 400 and the like). Depending on the shifting path, a shifting direction of an image according to the input image data IDATA1 in the display panel 100 may be determined. An image according to the input image data IDATA1 may be shifted along a direction determined by the shifting path within the image shifting range in the display panel 100 (e.g., the x-axis direction or y-axis direction).

Figure 2:
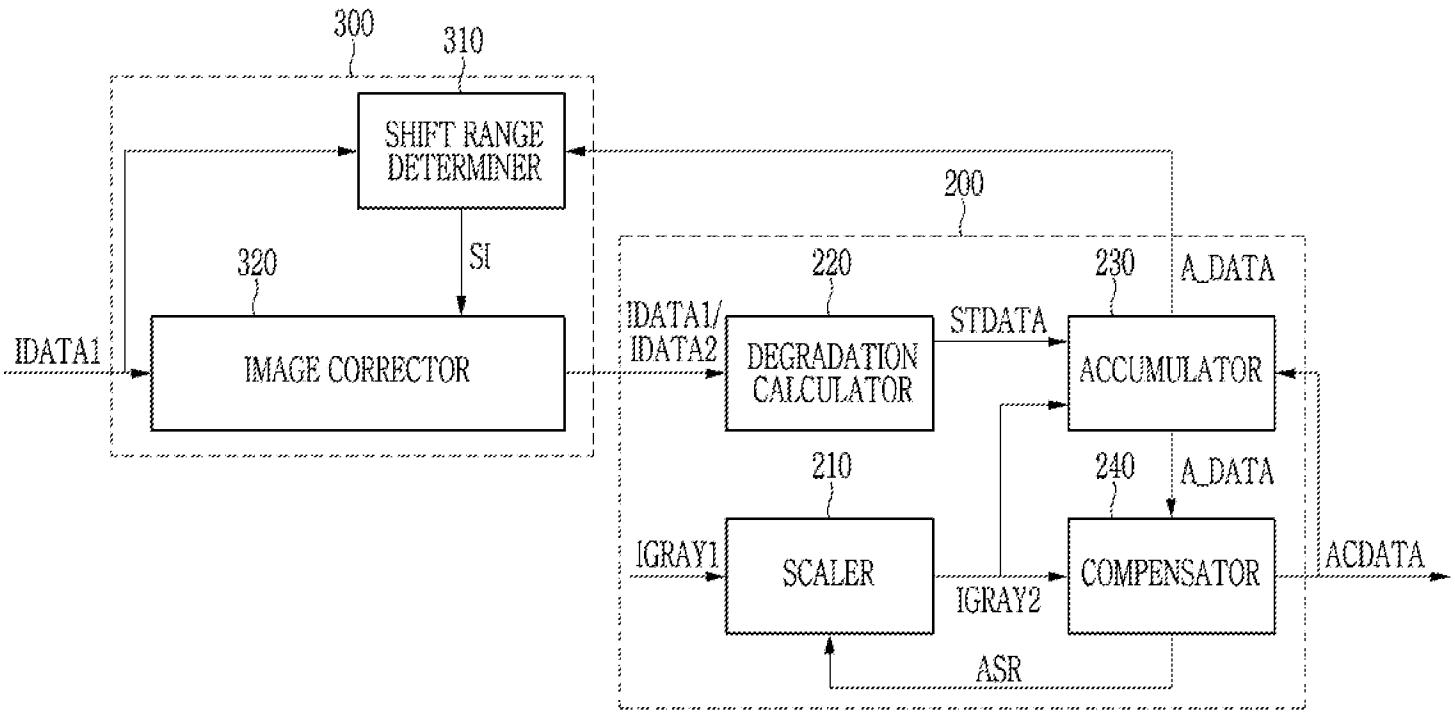
FIG. 2 is a detailed block diagram of the image shifter and the image sticking compensator according to an exemplary embodiment.

Next, the image sticking compensator 200 will be described in detail with reference to FIG. 2 through FIG. 4. FIG. 2 is a detailed block diagram of the image shifter and the image sticking compensator according to an exemplary embodiment, FIG. 3 is a graph that shows an example in which the image sticking compensator of FIG. 2 carries out image sticking, and FIG. 4 is a graph that shows an example of a relationship between an input grayscale and an output grayscale according to deterioration accumulation according to exemplary embodiments.

Referring to FIG. 2, the image sticking compensator 200 may include a scaler 210, a degradation calculator 220, an accumulator 230, and a compensator 240. The image sticking compensator 200 may compensate image data (or input grayscale data) to prevent permanent image sticking due to degradation accumulation.

Figure 3:
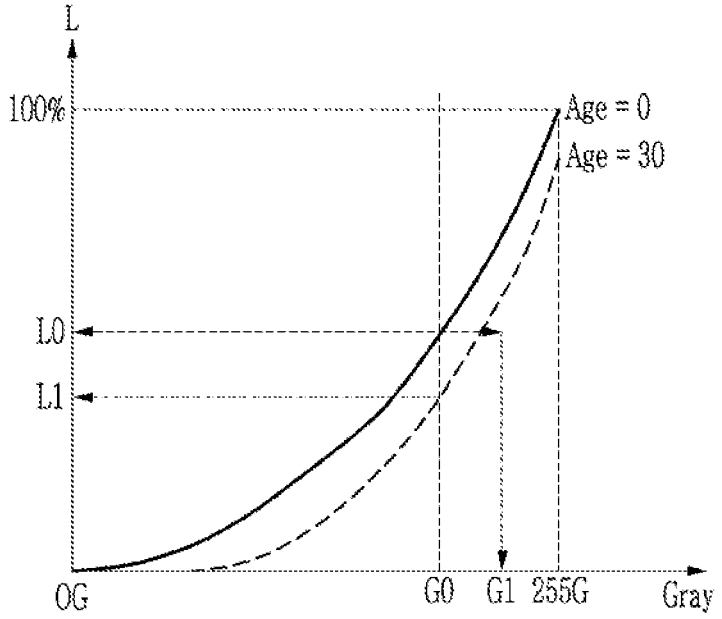
FIG. 3 is a graph that shows an example in which the image sticking compensator of FIG. 2 carries out image sticking.
Figure 4:
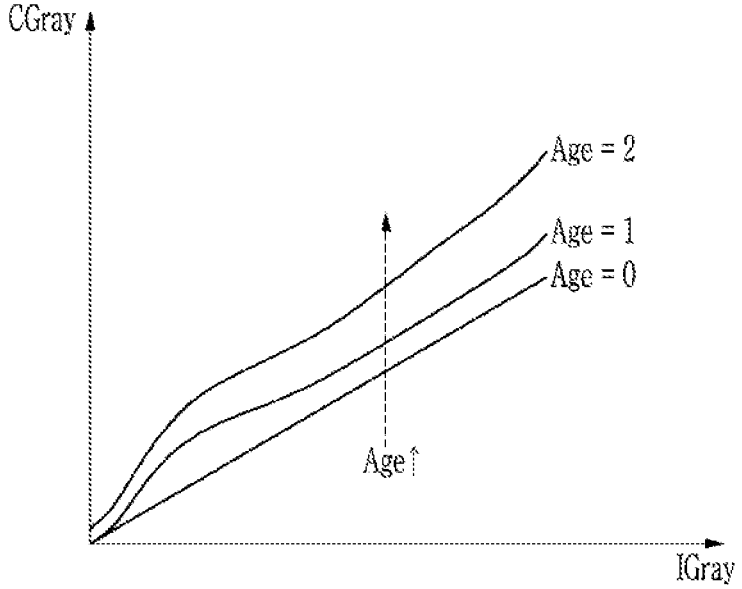
FIG. 4 is a graph that shows an example of a relationship between an input grayscale and an output grayscale according to deterioration accumulation according to exemplary embodiments.

FIG. 3 shows a relationship between a grayscale and luminance according to degradation or age accumulation. As shown in FIG. 3, at an initial stage (i.e., Age=0, where Age denotes a life-span value, which is assembled to be a 10-bit data value), when an input grayscale IGRAY1 corresponding to a first grayscale (i.e., G0) is input, a pixel may emit with a corresponding luminance, which is a first luminance (i.e., L0). When the pixel is degraded, (e.g., when the graph is shifted to Age=30 from Age=0), the display luminance may be lowered to a second luminance L1 based on an input of the first grayscale G0. Thus, the image sticking compensator 200 may compensate the input grayscale to a level of a second grayscale G1 to achieve a light emission with the first luminance L1.

The degradation calculator 220 calculates a degradation weight value based on the input image data (IDATA1 or IDATA2), and calculates degradation data STDATA of one frame (e.g., the present frame). The degradation calculator 220 may calculate a degradation weight value based on a panel condition. In an exemplary embodiment, the degradation weight value may be calculated based on at least one of a position of the corresponding pixel in the display panel 100, a size of an input grayscale, a current temperature of the display panel 100, an emission duty of the corresponding pixel, and a light emission frequency. The degradation calculator 220 may provide degradation data STDATA of a current frame to which the degradation weight value is applied, to the accumulator.

The accumulator 230 accumulates degradation data STDATA and generates age data A_DATA, which represents an accumulation of the degradation data STDATA. The age data A_DATA may include life-span information (i.e., degradation data) of each pixel. For example, the age data may include a plurality of age values, represented as 10-bit data. As shown in FIG. 4, as accumulation of the degradation data SDATA is increased, the amount of degradation is increased and the value of the age data A_DATA may increase (e.g., increased in the order of from Age=0 to Age=2).

Thus, as the pixel degradation progresses, a grayscale compensation value CGRAT (e.g., a grayscale compensation value of age compensation data) for displaying a predetermined input grayscale IGRAY may be increased. The accumulator 230 accumulates degradation data STDATA and scaled grayscale IGRAY2 together, per frame, to update the age data A_DATA. That is, the grayscale compensation value CGRAY may correspond to a grayscale compensated to display the predetermined input grayscale IGRAY at a specific age value that corresponds to the age data A_DATA. The accumulator 230 may provide the age data A_DATA to the compensator 240.

In an exemplary embodiment, the accumulator 230 may generate the age data A_DATA by accumulating the degradation data SITDATA and a grayscale of the age compensation data ACDATA together. The accumulator 230 may continuously accumulate age data A_DATA on which age compensation is performed.

The compensator 240 may determine a grayscale compensation value that corresponds to age data A_DATA and an input grayscale IGRAY. The compensator 240 may output age compensation data ACDATA by applying the grayscale compensation value to the input gray IGRAY or scaled grayscale IGRAY2. The compensator 240 may calculate the grayscale compensation value individually for each grayscale corresponding to grayscales displayed by respective pixels rather than collectively calculating the compensation values based on the age data A_DATA.

In various embodiments, the compensator 240 may calculate the grayscale compensation value using a lookup table method or a function calculation method. Since a light emission efficiency and a degradation amount are different per displayed grayscale, it may be appropriate to apply a different compensation value depending on the displayed grayscale. The compensator 240 may determine an optimal compensation value by considering an accumulated degradation amount and all grayscales to be displayed in a current frame. A structure and operation of the compensator 240 will be described in detail later with reference to FIG. 8 to FIG. 13.

The scaler 210 may generate a grayscale IGRAY2 scaled from the input grayscale IGRAY1 based on a scaling ratio ASR that corresponds to the age data A_DATA. The image sticking compensator 200 compensates the input grayscale IGRAY1 with a value that is greater than the input grayscale so as to implement a target grayscale as the degradation data STIDATA is accumulated. However, there is a limit in a grayscale compensation value that may be compensated by the image sticking compensator 200. For example, in the case of a high grayscale, it may not be appropriate to compensate a grayscale over a specific threshold. That is, the grayscale may be saturated when a predetermined degradation data STIDATA is accumulated.

Thus, as the scaler 210 performs down-scaling on the input grayscale IGRAY1 according to the degradation accumulation amount, the compensator 240 may calculate an optimal compensation value with respect to the entire grayscale areas without saturation of a compensation value. In an exemplary embodiment, the scaler 210 may receive a scaling ratio ASR corresponding to the age data A_DATA from the compensator 240. For example, the compensator 240 may include lookup data where a plurality of scaling ratios ASR are set according to the age data A_DATA. In an exemplary embodiment, the scaler 210 may provide the scaled gray IGRAY2 to the accumulator 230 and the compensator 240. The accumulator 230 may generate the age data A_DATA by accumulating the scaled grayscale IGRAY2 and the degradation data STDATA, and the compensator 240 may generate the age compensation data ACDATA based on the scaled grayscale IGRAY2 and the age data A_DATA. The scaler 210 will be described in detail later with reference to FIG. 10 to FIG. 12.

Next, referring to FIG. 5 to FIG. 7, the image shifter 300 will be described.

Figure 5:
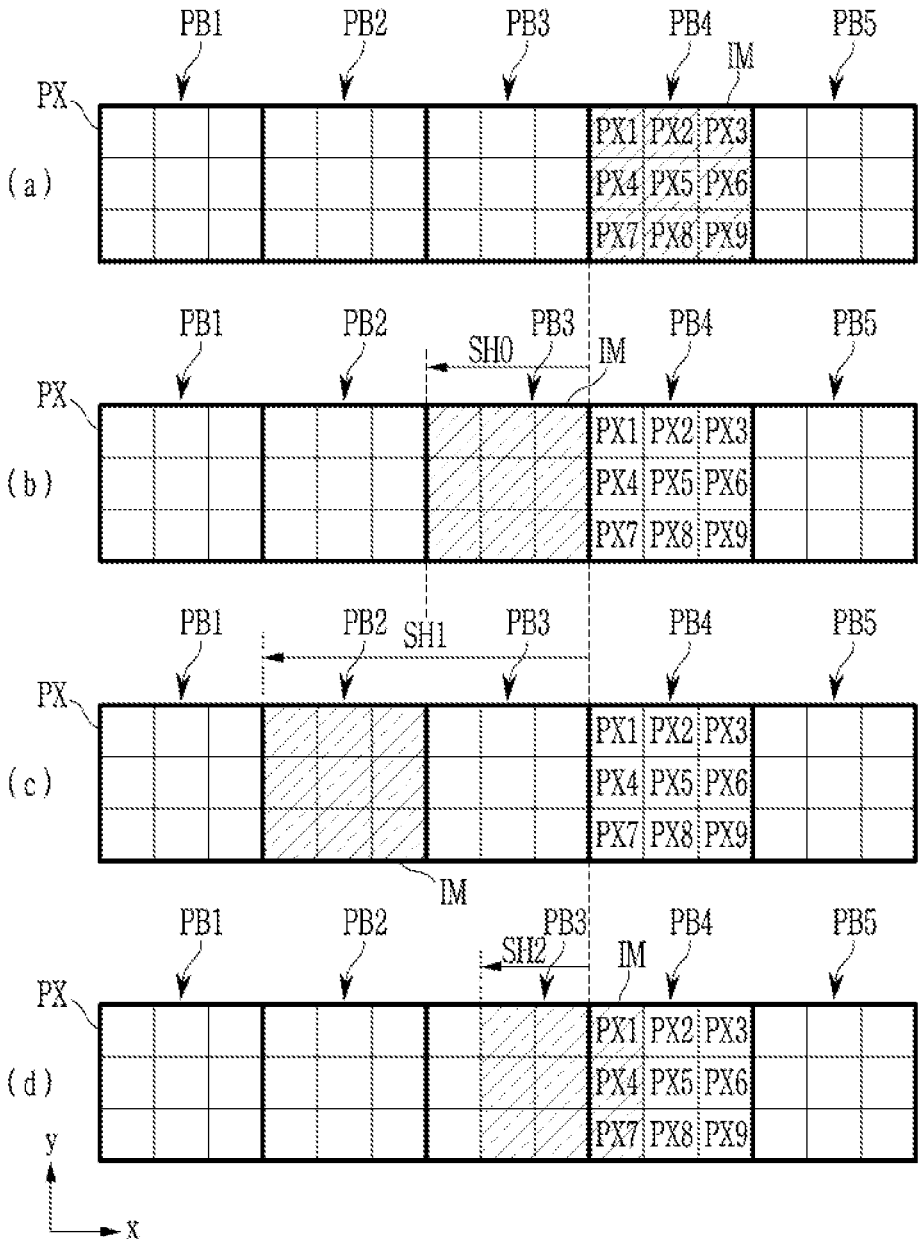
FIG. 5 is a schematic view of an example in which the image shifter determines an image shift range differently according to degradation of pixels according to exemplary embodiments.

FIG. 5 is a schematic view of an example in which the image shifter determines an image shift range differently according to degradation of different pixels according to exemplary embodiments. FIG. 6 and FIG. 7 are schematic views of an example in which the image shifter of FIG. 2 generates image data to be shifted in one direction according to exemplary embodiments.

Referring to FIG. 2, the image shifter 300 may include a shift range determiner 310 and an image corrector 320. The shift range determiner 310 may determine the necessity of stress dispersion using the age data A_DATA transmitted from the image sticking compensator 200 and the input image data IDATA1, and may also determine an image shift range of an image of a current frame based on the result of the first determination. For example, the shift range determiner 310 may determine an image shift range corresponding to age values of pixels of a pixel block displaying an image by the input image data IDATA1.

In FIG. 5, (a), (b), and (c) show an increase of an image shift range according to an increase of an age value of a pixel block PB4 (e.g., an age value of a pixel is increased as Age=0, Age=30, and Age=60). It is assumed that the image shift direction in this example is a shift in the negative x-axis direction.

Referring to (a) of FIG. 5, a data signal according to a grayscale for the input image data IDATA1 is input to the pixel block PB4 to achieve a light emission with a corresponding luminance. In this case, the shift range determiner 310 may determine an image shift range by considering an age value of the pixel block PB4 corresponding to the input image data ODATA1. In this case, the shift range determiner 310 may determine an image shift range by using an average aging value of pixels included in a pixel block.

As shown in (a) of FIG. 5, an image shift range is determined such that an image IM is not shifted at an initial stage. As shown in (b) of FIG. 5, when degradation proceeds (Age=30), the image shift range is determined to be SH0 such that the image IM is shifted by one pixel block unit. In this case, the image IM to be displayed in the pixel block PB4 is displayed in a pixel block PB3. As shown in (c) of FIG. 5, when the degradation further proceeds (i.e., Age=60), the moving shift range is determined to be SH1 such that the image IM is shifted by two pixel block units. In this case, the image IM to be displayed in the pixel block PB4 is displayed in a pixel block PB2.

When it is determined that an age value exceeds a threshold level (e.g., Age=800, due to continuing pixel degradation), the shift range determiner 310 may reduce the image shift range. That is, if the image shift range is continuously increased as the age value of the pixel increases, severe image distortion may occur. Thus, when an average of age values of pixels included in a pixel block exceeds a threshold level, as shown in (d) of FIG. 5, the image shift range is determined to be SH2 such that the image IM is shifted by two pixel units.

The shift range determiner 310 may provide shift range information IS that includes a determined image shift range to the image corrector 320. The image corrector 320 may then supply first input image data IDATA1 or second image data DATA2 to the display panel 100 based on the shift range information SI. The image corrector 320 may correct the first input image data IDATA1 to generate shifted second image data DATA2 such that an image displayed in the display panel 100 is sequentially shifted along a predetermined shift path.

When the shift range information IS includes an image shift range of a current frame image, the image corrector 320 may correct the first input image data IDATA1 to the second image data DATA2 and then provide it to the display panel 100, so that the current frame image is shifted within the shift enabled range. On the other hand, when the shift range information SI includes information that does not shift the current frame image, the image corrector 320 may supply the first input image data IDATA1 to the display panel 100, and the current frame image will not be shifted.

The image correction of the image corrector 320 will now be described with reference to FIG. 6 and FIG. 7. As shown in FIG. 6, an image IM1 may be displayed in a display area DA. When the image IM1 is shifted to the left, an image IM1' is displayed in the display area DA. As the image IM1 is shifted, a part of the image IM1 may be reduced or enlarged.

For example, when the image IM1 is shifted to the left, a left area A1 of the image IM1 is reduced by as much as a first area Ex1 and thus becomes a left area B1 of the image IM1', and a right area A2 of the image IM1 is enlarged by as much as a second area Ex2 and thus becomes a right area B2 of the image IM1'. In addition, when the image IM1 is shifted to the left, a center area A0 becomes a center area B0 of the image IM1'.

Figure 7:
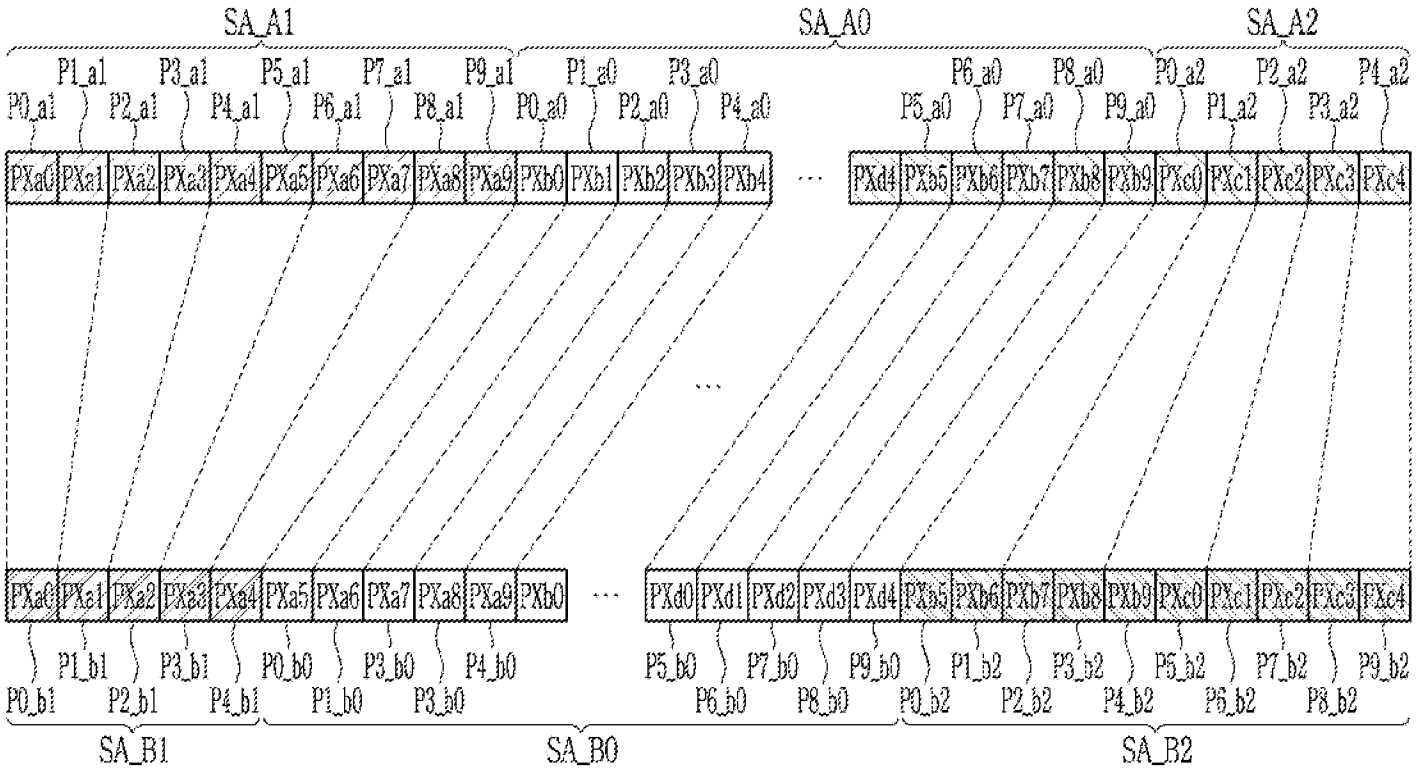

Referring to FIG. 7, x-axis image data to be input to pixels in one row is illustrated. A subarea SA_A0 before an image is shifted is included in the center area A0 of the image IM1, a subarea SA_A1 before the image is shifted is included in the left area A1 of the image IM1, and a subarea SA_A2 before the image is shifted is included in the right area A2 of the image IM1.

Pixels PXa0 to PXa9 display image data P0_a1-P9_a1 of the subarea SA_A1 before the image is shifted, pixels PXb0 to PXb9 display image data P0_a0 to P9_a0 of the subarea SA_A1 before the image is shifted, and pixels PXc0 to PXa4 display image data P0_a2 to P4_a2 of the subarea SA_A2 before the image is shifted.

A subarea SA_B0 after the image is shifted is included in the center area B0 of the image IM1', a subarea SA_B1 after the image is shifted is included in the left area B1 of the image IM1', and a subarea SA_B2 after the image is shifted is included in the right area B2 of the image IM1'.

The pixels PXa0 to PXa4 display image data P0_b1 to P4_b1 of the subarea SA_B1 after the image is shifted, the pixels PXa5 to PXa9 and pixels PXd0 to PXd4 display image data P0_b0 to P9_b0 of the subarea SA_B0 after the image is shifted, and the pixels PXb5 to PXb9 and PXc0 to PXc4 display image data P0_b2 to P9_b2 of the subarea SA_B2 after the image is shifted.

The image corrector 320 may correct image data to be provided to p pixels (here, p is, for example, 10) PXa0 to PXa9 before the image is shifted to image data to be provided to q pixels (here, q is, for example, 5) PXa0 to PXa4. An image displayed on the p pixels is disposed on the q pixels, and thus an image displayed in the subarea SA_b1 is reduced by k times (k=q/p) compared to an image displayed in the subarea SA_b1 before being shifted.

The image corrector 320 may generate input data P0_b1 to P4_b1 to be input to the five pixels PXa0 to PXa4 using image data P0_a1-P9_a1 to be input to 10 pixels PXa0 to PXa9. For example, the image corrector 320 may generate image data P0_b1 to be input to the pixel PXa1 after the image is shifted by using image data P0_a1 to be input to the pixel PXa0 and input data P2_a1 to be input to the pixel PXa1 before the image is shifted. Similarly, the image corrector 320 may generate image data P1_b1 to be input to the pixel PXa1 after the image is shifted by using image data P2_a1 to be input to the pixel PXa2 and image data P3_a1 to be input to the pixel PXa3.

Thus, the image corrector 320 may display an image (corresponding to image data P0_b1 to P4_b1) which is reduced compared to the image displayed in subarea SA_A1 before the image is shifted. The image may be displayed in the subarea SA_B1 after the image is shifted by using image data P0_a1 to P9_a1. The image displayed in the subarea SA_A1 before the image is shifted may be reduced by half and then displayed in the subarea SA_B1 after the image is shifted.

Regarding the reduced image generation, an enlarged image may be generated by using an interpolation method in which weight values are combined by applying the weight values themselves or combined by further including image data input to peripheral pixels. However, a description of such a method will be omitted.

The image corrector 320 may correct image data to be provided to i pixels PXc0-PXc4 (here, i is 5) before image shifting to image data to be provided to j pixels PXd0 to PXd and PXc0 to PXc4 (here, j is 10). Since an image displayed on i pixels is shifted to be displayed on j pixels, the image displayed in the after-shifting subarea SA_B2 may be enlarged by h times (where h=j/i) compared to the before-shifting subarea SA_A2.

For example, the image corrector 320 may generate image data P0_b2 to P9_b2 to be input to the ten pixels PXd0 to PXd4 and PXc0 to PXc4 by using image data P0_a2 to P4_a2 to be input to the five pixels PXc0 to PXc4. For example, the image corrector 320 may generate image data P9_b2 and P8_b2 to be input to pixel PXc4 and pixel PXc3 after image-shifting by using image data P4_a2 to be input to the pixel PXc4 before image-shifting. Similarly, the image corrector 320 may generate image data P7_b2 and P6_b2 to be input to pixel PXc2 and pixel PXc1 after image-shifting by using image data P3_a2 to be input to the pixel PXc3 before image-shifting.

Accordingly, the image corrector 320 may display an image (image data P0_b2 to P9_b2) which is enlarged from an image displayed in the subarea SA_A2 before the image is shifted in the subarea SA_B2 after the image is shifted by using image data P0_a2 to P4_a2. For example, the image displayed in the subarea SA_A1 before the image is shifted may be enlarged by two times and then displayed in the subarea SA_B1 after the image is shifted.

Regarding the enlarged image generation, an enlarged image may be generated by using an interpolation method in which weight values are combined by applying the weight values themselves or combined by further including image data input to peripheral pixels. However, a description of such a method will be omitted.

Figure 6:
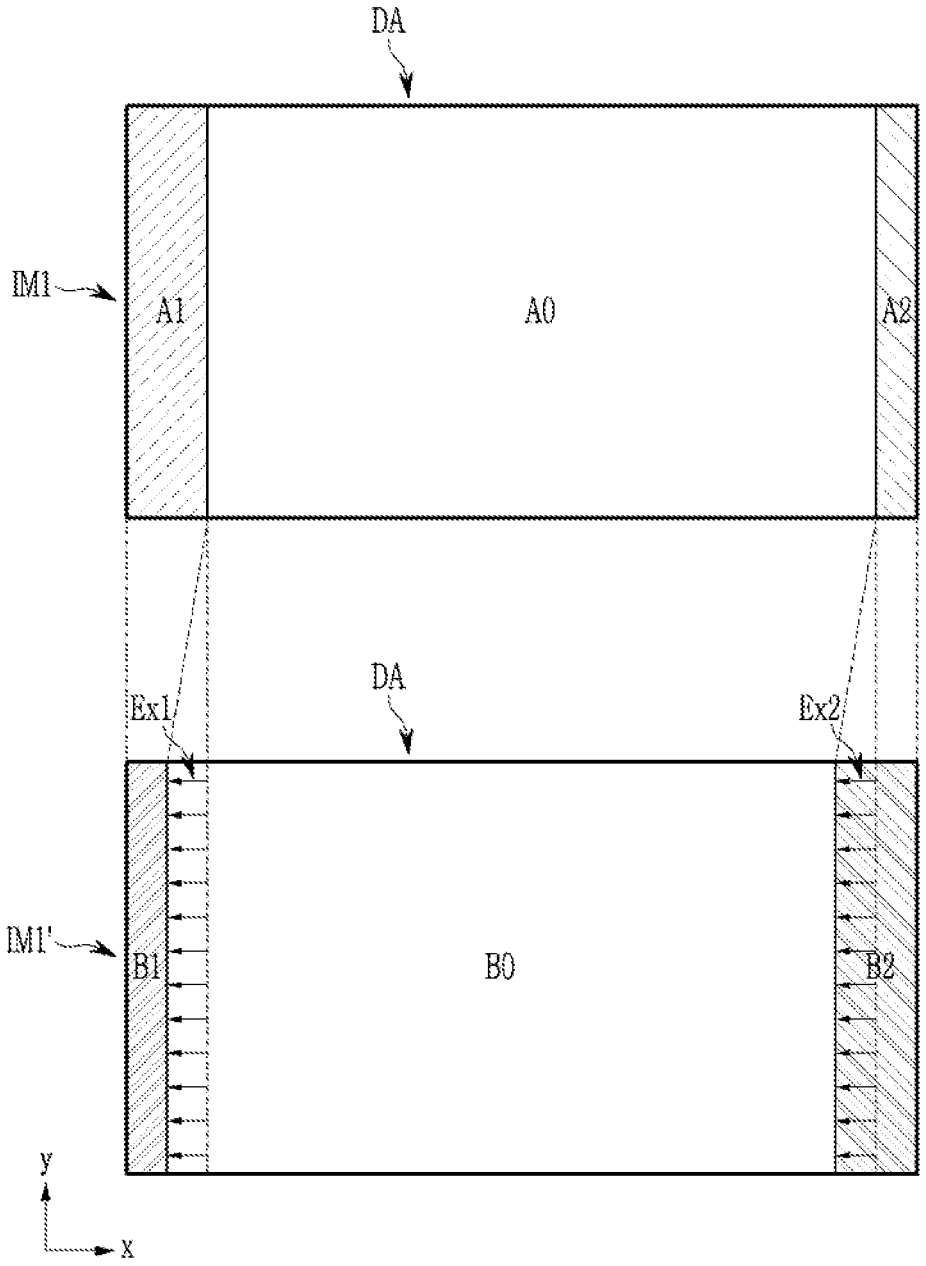
FIG. 6 and FIG. 7 are schematic views of an example in which the image shifter of FIG. 2 generates image data to be shifted in one direction according to exemplary embodiments.

It is assumed in FIG. 5 to FIG. 7 that the image shifting direction is the x-axis direction, but the image corrector 320 may correct an image similarly when the image shifting direction is the y-axis direction (or the negative x-axis direction or the negative y-axis direction), and this will not be further described.

Thus, due to image shifting, the left area A1 and the right area A2 of the original image IM1 are respectively reduced or enlarged, thereby causing image distortion.

Figure 8:
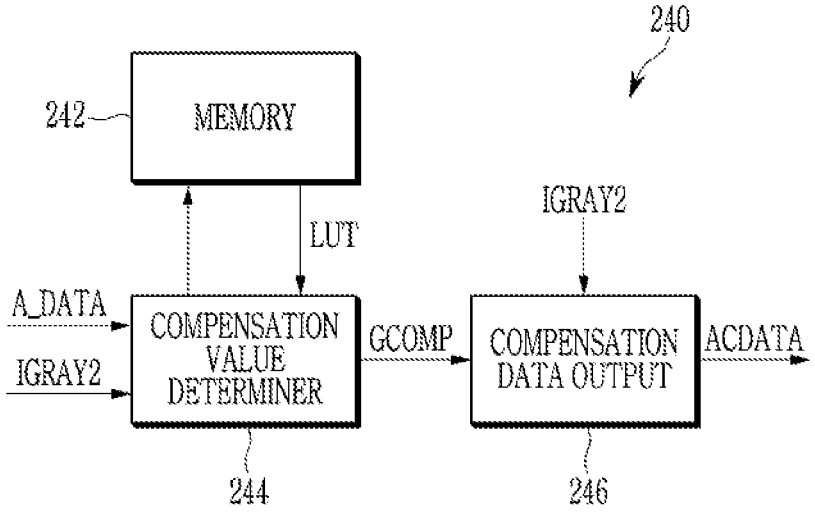
FIG. 8 is a block diagram of an example of a compensator included in the image sticking compensator of FIG. 2.

FIG. 8 is a block diagram of an example of a compensator included in the image sticking compensator of FIG. 2. Referring to FIG. 8, a compensator 240 of the image sticking compensator 200 may include a memory 242, a compensation value determiner 244, and a compensation data output component 246. In an exemplary embodiment, the compensator 240 may determine grayscale compensation data GCOMP by using a lookup table.

In this embodiment, the memory 242 may include a plurality of lookup tables having a plurality of pre-determined age values corresponding to the age data and compensation values that correspond to display grayscales which may be realized by the display panel 100. A single lookup table may include respective age values and compensation values that simultaneously correspond to the respective grayscales. In an exemplary embodiment, the lookup tables may be distinguished according to colors of pixels included in the display panel 100 and a temperature of the display panel 100. In various embodiments, the memory 242 may include static access memory (SRAM) or dynamic random access memory (DRAM) for storing the lookup tables.

The compensation value determiner 244 may determine grayscale compensation data GCOMP that corresponds to the age data A_DATA and the scaled grayscale IGRAY2 from the lookup tables. In an exemplary embodiment, the compensation value determiner 244 may select one of the lookup tables based on a current temperature of the display panel 100 and based on the color of the pixels. The compensation value determiner 244 may determine grayscale compensation data GCOMP that corresponds to the age data A_DATA and the scaled grayscale IGRAY2 from the selected lookup table. Thus, grayscale compensation data GCOMP may be based on a light emission color of a pixel, the degree of degradation (age), a temperature, and a grayscale to be displayed.

The compensation data output component 246 may output age compensation data ACDATA by applying the grayscale compensation data GCOMP and the scaled grayscale IGRAY2. Here, the age compensation data ACDATA may have a digital format defined by a grayscale domain.

As described above, since the image sticking compensator 200 includes the compensator 240 that calculates grayscale compensation data GCOMT optimized according to accumulated age data A_DATA and grayscales, precision in the compensation of image sticking may be significantly improved and grayscales may be individually compensated by pixel. Accordingly, the image sticking with respect to all grayscales may be reduced. If the grayscale compensation data GCOMP is set in lookup tables, compensation logic can be simplified, thereby simplifying design. However, if the grayscale compensation data GCOMP is determined algorithmically, the precision of the grayscale compensation data GCOMP may be increased.

Figure 9:
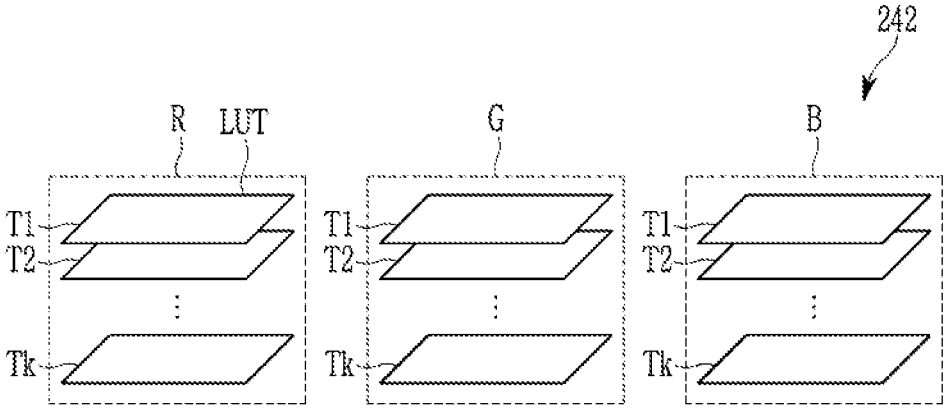
FIG. 9 is a block diagram of an example of a memory included in the compensation portion of FIG. 8.
Figure 11:
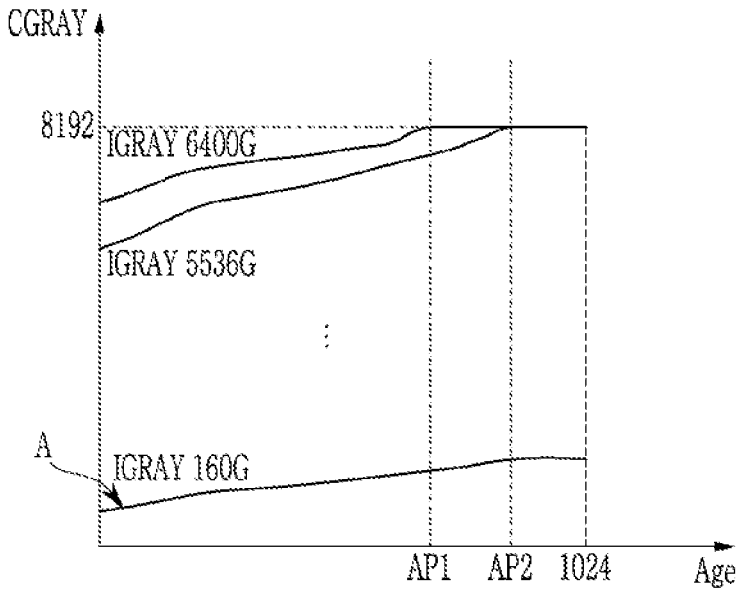
FIG. 11 and FIG. 12 are graphs provided for description of examples of age compensation data set by the lookup table of FIG. 10.
Figure 12:
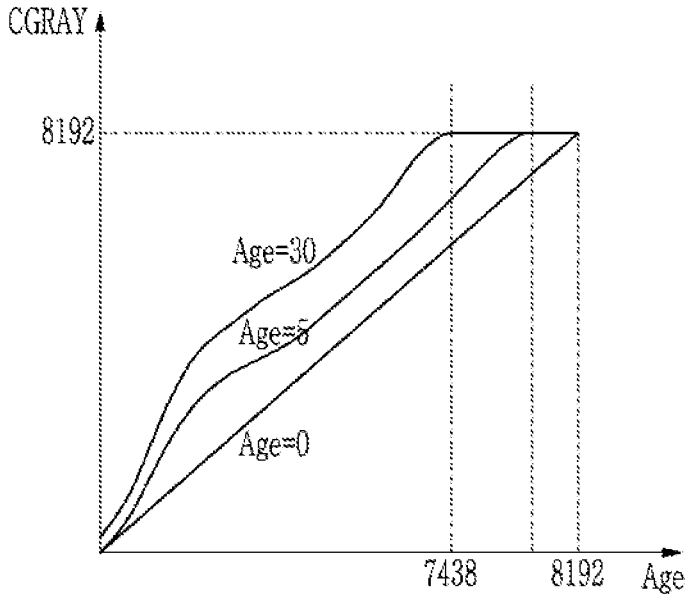

FIG. 9 is a block diagram of an example of a memory included in the compensation portion of FIG. 8, FIG. 10 is a block diagram of an example of a lookup table included in the memory of FIG. 8, and FIG. 11 and FIG. 12 are graphs provided for description of examples of age compensation data set by the lookup table of FIG. 10.

Referring to FIG. 9 to FIG. 12, the compensator 240 may determine the grayscale compensation data GCOMP by using a lookup table. In an exemplary embodiment, as shown in FIG. 9, the memory 242 may include a plurality of lookup tables LUT. The lookup tables LUT may be respectively set according to pixel light emission colors and the temperature of the display panel 100. For example, the light emission colors may be classified into red, green, and blue, and the lookup tables may be classified into a first table group R applied to red pixels, a second table group G applied to green pixels, and a third table group B applied to blue pixels (or sub-pixels). Further, the first to third table groups R, G, and B may include a plurality of lookup tables LUT that correspond to predetermined temperatures. For example, the respective table groups R, G, and B may include lookup tables that respectively correspond to first to k-th predetermined temperatures T1 to Tk. The first to k-th predetermined temperatures T1 to Tk may respectively include specific temperature ranges or may include specific temperature values. In an exemplary embodiment, grayscale compensation data GCOMP with respect to a predetermined temperature may be calculated by using interpolation between the lookup tables.

As shown in FIG. 10, compensation values that correspond to a predetermined plurality of age values AGE and display grayscales GRAY that may characterize the display panel 100 may be set in a lookup table that corresponds to a first temperature T1 and the color red. FIG. 10 shows a lookup table in which display grayscales are divided into 256 levels (i.e., 8 bits), and compensated to 13-bit compensation values (e.g., compensation grayscale). In addition, the age values AGE may be divided into 1024 levels (i.e., 10 bits) according to degradation accumulation. The age data A_DATA received by the compensator 240 may correspond to one of the age values AGE. However, the values illustrated in FIG. 10 represent an illustrative example, and the number of bits that represent the display grayscales, the compensation values, and the age values are not limited thereto.

In an exemplary embodiment, the lookup table LUT may include scaling ratios ASR that respectively correspond to the age values AGE. In an exemplary embodiment, the compensator 240 may provide a scaling ratio ASR that corresponds to age data A_DATA to the scaler 210. The scaler 210 may generate a grayscale IGRAY2 scaled from the input grayscale IGRAY1 with a scaling ratio ASR. That is, as shown in FIG. 10, when the age value AGE is increased, the compensation values are saturated to a level represent by the value 8192, and thus in order to prevent occurrence of saturation, the input grayscale IGRAY1 may be down-scaled with a scaling ratio ASR according to an age value AGE.

FIG. 11 shows a relationship between degradation accumulation (e.g., the age data A_DATA described herein) and a grayscale compensation value CGRAY of age compensation data. That is, as the degradation accumulation is increased, the grayscale compensation value CGRAY of the age compensation data can be increased. For example, as the degradation is accumulated, the grayscale compensation value CGRAY may be increased to display an image of 64 grayscales (shown in A in FIG. 11). However, in case of 5536 grayscales, the maximum compensation value is applied from a first age value (denoted as AP1), and accordingly the grayscale compensation value CGRAY is saturated. Thus, in some cases precise compensation may not be carried out with respect to age data after the first age value AP1, and display grayscales and luminance with respect to an input grayscale (i.e., 5536 grayscales) may be reduced. As shown in FIG. 11, after a second age value (denoted as AP2), both 6400 grayscales and 5536 grayscales may have the same grayscale compensation value CGRAY.

These circumstances may be mitigated by the application of the scaler 210. The scaler 210 may down-scale input grayscale data IGDATA1 by applying scaling ratios ASR that correspond to the age values AGE to the input grayscale data IGDATA1. Accordingly, the saturation area is removed in the graph of FIG. 11 and precise image sticking compensation may be carried out. For example, when an age value corresponding to age data A_DATA is 5 (i.e., AGE=5 in FIG. 10), the input grayscale may be multiplied by a scaling ratio of 0.982.

FIG. 12 shows a relationship between an input grayscale IGRAY and a grayscale compensation value CGRAY of the input grayscale data IGDATA1. When the age value is 30 (i.e., Age=30), the grayscale compensation value CGRAY of the age compensation data may be saturated from about 7438 grayscales. In this case, the scaler 210 may remove the saturation area by applying a scaling ratio AST that corresponds to the age value to the input grayscale IGRAY. Thus, image sticking compensation with respect to the entire grayscale areas can be more precisely carried out.

As described above, the image sticking compensator 200 includes the scaler 210 and the compensator 240 for calculation of optimal grayscale compensation data GCOMP according to accumulated age data A_DATA and grayscales, and accordingly, precision in image sticking compensation can be significantly improved and all the grayscales can be individually compensated. Accordingly, image sticking with respect to the entire grayscales are invisible. In addition, since the grayscale compensation data GCOMP is set in the plurality of lookup tables, compensation logic can be simplified, thereby easing a design.

FIG. 13 shows an example in which the compensator of FIG. 8 further applies a block weight value to the age data. Referring to FIG. 13, the compensator 240 divides the display panel 100 into a plurality of pixel blocks, and sets block weight values with respect to the respective pixel blocks. For example, as shown in FIG. 9, the display panel 100 may be divided into a*b pixel blocks, and each pixel block may be set with a predetermined block weight value.

The compensator 240 may further apply a block weight value of a pixel block that corresponds to the position of a pixel to age data A_DATA received from the accumulator 230. The compensator 240 may determine the grayscale compensation data GCOMP based on the age data A_DATA to which the block weight value is applied. For example, the compensator 240 may determine the grayscale compensation data GCOMP based on an age value Age that corresponds to the age data A_DATA to which the block weight value is applied, and an input grayscale.

The compensator 240 may correct a block weight value by using age data A_DATA. For example, when it is determined that pixel degradation continuously proceeds and thus the age value exceeds the threshold value (e.g., Age=800), the compensator 240 may correct a block weight value applied to neighboring pixels of the degraded pixel. A method for the compensator 240 to correct the block weight value will now be described with reference to FIG. 14.

Figure 14A:
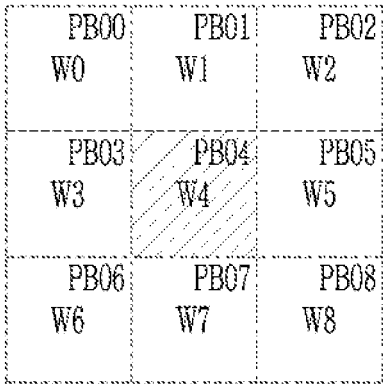
FIGS. 14A and 14B show an example in which the compensator of FIG. 8 corrects and applies a block weight value.
Figure 14B:
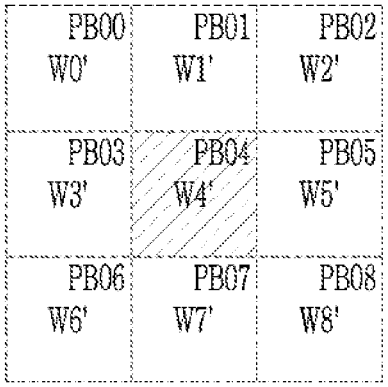

FIGS. 14A and 14B show an example in which the compensator of FIG. 8 corrects and applies a block weight value. FIG. 14A shows the block weight values before compensation, and FIG. 14B shows the values after compensation. The display panel 100 may be divided into a*b pixel blocks and a predetermined block weight value is set to each of the pixel blocks. Then the compensator 240 corrects block weight values of any one pixel block and block weight values of neighboring blocks of the pixel block by using an average of age values of pixels included in the pixel block.

As shown in FIG. 14A, block weight values W0 to W8 are set to pixel blocks PB00 to PB08. Here, it is assumed that an average of age values of pixels included in the pixel block PB04 exceeds the threshold value, and an average of age values of pixel blocks PB00 to PB03 and PB05 to PB08, excluding the pixel block PB04, does not exceed the threshold value.

Since the average of the age values of the pixels included in the pixel block PB04 exceeds the threshold value, the compensator 240 may correct block weight values of the pixel blocks PB00 to PB08. For example, the compensator 240 may lower the block weight values of the pixel blocks PB00 to PB08 to be lower than the original block weight values.

Thus, a saturation area can be removed by the scaler 210. However, in order for a significantly degraded pixel (hereinafter referred to as a degraded pixel) to emit light with the same luminance as a pixel that is not significantly degraded (hereinafter referred to as a normal pixel), a higher grayscale must be input to the degraded pixel than for the normal pixel. Thus, higher grayscale data is input to the degraded pixel, which results in higher current flows. Accordingly, degradation of the degraded pixel may become even more severe.

Therefore, according to an exemplary embodiment, the compensator 240 may further lower the block weight values applied to the degraded pixel (or degraded pixel block) and the neighboring pixels (or pixel blocks) in order to prevent additional degradation of the degraded pixel. Luminance of the degraded pixel (or degraded pixel block) and luminance of the neighboring pixels (or pixel blocks) may be lowered so that visibility of image sticking due to the degraded pixel (degraded pixel block) can be prevented and at the same time, by the lowered block weight value, a grayscale data value input to the degraded pixel (degraded pixel block) is decreased, thereby preventing further degradation of the degraded pixel (degraded pixel block).

The compensator 240 may set the block weight values of pixel blocks PB00 to PB03 and PB05 to PB08 to be lower than their original block weight values, and a block weight value of a degraded pixel block PB04 may be corrected to maintain its original block weight value. That is, when the grayscale compensation value of the degraded pixel block PB04 is saturated, block weight values of the neighboring pixel blocks PB00 to PB03 and PB05 to PB08 may be lowered to prevent occurrence of image sticking due to the degraded pixel block PB04. Furthermore, if the degraded pixel block PB04 emits light with luminance that is lower than targeted luminance, luminance of the neighboring pixel blocks PB00 to PB03 and PB05 to PB08 may be lowered to prevent visibility of the image sticking.

Figure 15:
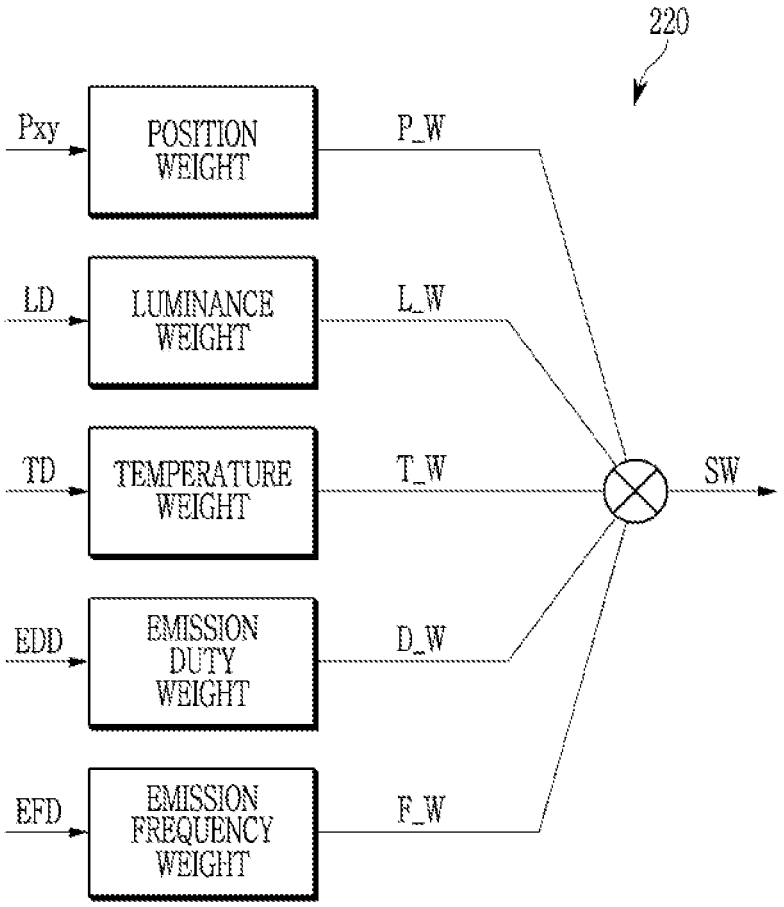
FIG. 15 shows an example of a degradation calculator included in the image sticking compensator of FIG. 2.

FIG. 15 shows an example of a degradation calculator included in the image sticking compensator of FIG. 2. Referring to FIG. 15, the degradation calculator 220 may calculate a degradation weight value SW based on input image data.

The input image data may include information such as a position Pxy of a pixel, a luminance LD, a light emission duty EDD, a light emission frequency EFD, and the like. Further, the degradation calculator 220 may further receive current temperature data TD of the display panel, as detected by an external temperature detector. The degradation calculator 220 may calculate at least one of a position weight value P_W that corresponds to the position Pxy of the pixel, a luminance weight value L_W that corresponds to the luminance L_D, a light emission duty weight value D_W that corresponds to the light emission duty EDD, a light emission frequency weight value F_W that corresponds to the light emission frequency EFD, and a temperature weight value T_W that corresponds to a current temperature TD of the display panel. That is, the degradation weight value SW may include at least one of the positive weight value P_Q, the luminance weight value L_W, the duty weight value D_W, the light emission frequency weight value F_W, and the temperature weight value T-W. The degradation calculator 220 may calculate degradation data STDATA of one frame based on the degradation weight value SW.

Figure 16:
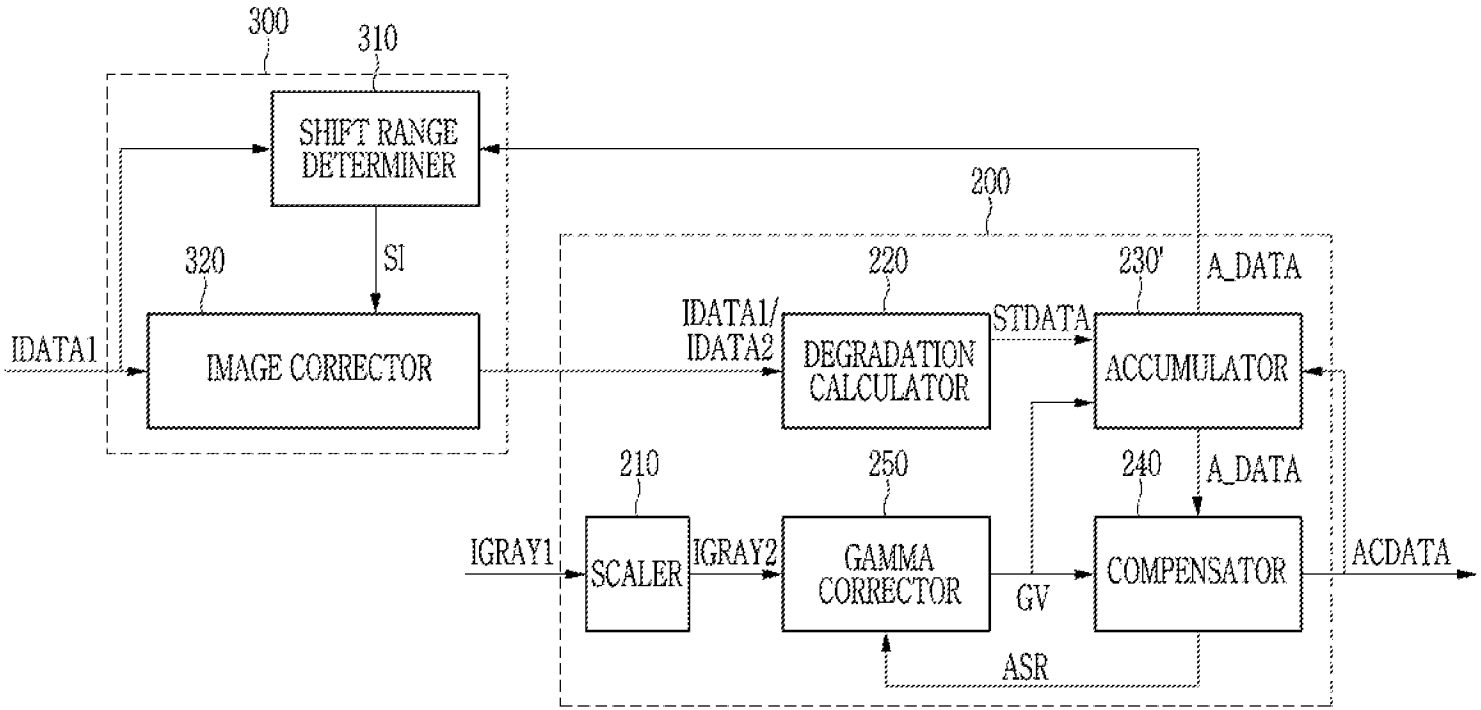
FIG. 16 is a detailed block diagram of an image shifter and an image sticking compensator according to another exemplary embodiment.

FIG. 16 is a detailed block diagram of an image shifter and an image sticking compensator according to another exemplary embodiment. An image sticking compensator according to the present exemplary embodiment may include aspects of the image sticking compensator of FIG. 2. However, the image sticking compensator 200 of FIG. 16 may also provide age compensation data ACDATA to an accumulator. The same reference numerals are used for the same or corresponding components between FIG. 2 and FIG. 16, and redundant explanations are omitted.

Referring to FIG. 16, the image sticking compensator 200 may include a scaler 210, a degradation calculator 220, an accumulator 230', and a compensator 240. The compensator 240 of the image sticking compensator 200 may provide age compensation data or a grayscale compensation value CGRAY of the age compensation data ACDATA to the accumulator 230'.

The accumulator 230' may generate age data A_DATA' by accumulating the age compensation data ACDATA together with degradation data STD. That is, the accumulator 230' may continuously accumulate the age data A_DATA' on which age compensation is performed. Accordingly, the compensator 240 may output a grayscale compensation value and age compensation data based on the age data A_DATA'.

While this disclosure has been described in connection with what is presently considered to be practical exemplary embodiments, it is to be understood that the disclosure is not limited to the disclosed embodiments, but, on the contrary, is intended to cover various modifications and equivalent arrangements included within the spirit and scope of the appended claims.

What is claimed is:

1. A display device comprising:

a display panel that includes a plurality of pixels; and an image shifter configured to correct an image corresponding to input image data to be shifted based on age data with respect to the plurality of pixels and an input grayscale of input image data and outputs corrected image data, wherein the image shifter is further configured to increase a shift range of the image when an age value of the age data increases to an increased age value and the increased age value is below a threshold value, and the image shifter is further configured to reduce the shift range of the image when the age value of the age data exceeds the threshold value.

2. The display device of claim 1, wherein the shift range of the image is determined by a pixel unit when the age value of the age data exceeds the threshold value.

3. The display device of claim 2, wherein the shift range of the image is determined by a pixel block unit that includes a predetermined number of pixels when the age data is below the threshold value.

4. The display device of claim 1, further comprising an image sticking compensator configured to generate the age data, and further configured to output age compensation data based on the age data and an input grayscale of the corrected image data.

5. The display device of claim 4, wherein the image sticking compensator further comprises:

a degradation calculator configured to calculate a degradation weight value based on the corrected image data, and further configured to calculate degradation data of one frame;

an accumulator configured to accumulate the degradation data and further configured to generate degradation data-accumulated age data; and a compensator configured to determine a grayscale compensation value corresponding to the age data and the input grayscale of the input image data, and further configured to output age compensation data by applying the grayscale compensation value to the input image data.

6. The display device of claim 5, wherein the compensator is configured to divide the display panel into a plurality of blocks, to set block weight values with respect to the respective blocks, and to apply the block weight values to the age data, and to determine the grayscale compensation value based on the block weight value-applied age data.

7. The display device of claim 6, wherein, the compensator is configured to reduce block weight values of a block and neighboring blocks of the block when an average of age values of pixels included in the block exceeds the threshold value.

8. The display device of claim 5, further comprising a scaler configured to generate a grayscale scaled from the input grayscale based on a scaling ratio that corresponds to the age data, wherein the grayscale is configured to prevent saturation of the grayscale compensation value.

9. The display device of claim 1, wherein the image shifter is further configured to generate the corrected image data by enlarging or reducing an area in the image displayed by the input image data according to the image shift range.

10. A method for displaying an image of a display device, comprising:

calculating degradation weight values with respect to a plurality of pixels included in a display panel based on input image data, and calculating degradation data of one frame;

generating age data by accumulating the degradation data; and generating corrected image data by shifting an image corresponding to the input image data based on the age data and an input grayscale of the input image data, wherein a shift range of the image is reduced when an age value of the age data exceeds a threshold value, and wherein the shift range of the image is increased as the age value of the age data increases to an increased age value, wherein the increased age value is below the threshold value.

11. The method for displaying an image of the display device of claim 10, wherein, when the age value of the age data exceeds the threshold value, the shift range of the image is determined by a pixel unit.

12. The method for displaying an image of the display device of claim 11, wherein when the age data is below the threshold value, the shift range of the image is determined on the basis of a pixel block that includes a predetermined number of pixels.

13. The method for displaying an image of the display device of claim 10, further comprising, after generating the age data:

determining a grayscale compensation value that corresponds to the age data and an input grayscale of the input image data; and generating age compensation data by applying the grayscale compensation value to the input image data.

14. The method for displaying an image of the display device of claim 13, further comprising, before the grayscale compensation value is determined:

generating a grayscale scaled from the input grayscale based on a scaling ratio that corresponds to the age data, wherein the grayscale is configured to prevent saturation of the grayscale compensation value.

15. The method for displaying an image of the display device of claim 13, wherein the determining the grayscale compensation value comprises:

dividing the display panel into a plurality of blocks;

setting block weight values with respect to the blocks;

applying the block weight values to the age data; and determining the grayscale compensation value based on the age data to which the block weight value is applied.

16. The method for displaying an image of the display device of claim 15, wherein the setting the block weight values comprises reducing block weight values of a block and neighboring blocks of the block when an average of age values of pixels included in the block along the plurality of blocks exceeds the threshold value.

17. The method for displaying an image of the display device of claim 10, wherein the generating the corrected image data comprises generating the corrected image data by enlarging or reducing one area in an image displayed by the input image data according to the image shift range.

18. A display device comprising:

a display panel that includes a plurality of pixels; and an image sticking compensator configured to determine a grayscale compensation value corresponding to age data with respect to the plurality of pixels and input image data, and to output age compensation data by applying the grayscale compensation value to the input image data, wherein the image sticking compensator is further configured to divide the display panel into a plurality of blocks, set block weight values with respect to the respective blocks, apply the block weight value to the age data, and determine the grayscale compensation value based on the block weight value-applied age data, and wherein the image sticking compensator is further configured to reduce block weight values of a block and the neighboring blocks of the block when an average of age values of pixels included in the block along the plurality of blocks exceeds the threshold value.

* * * * *